US006831238B1

(12) United States Patent
Lau

(10) Patent No.: US 6,831,238 B1
(45) Date of Patent: Dec. 14, 2004

(54) FINGER-CONTROLLABLE MULTI-DIRECTIONAL SWITCH

(75) Inventor: Chung Kin Lau, Salo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/760,146

(22) Filed: Jan. 16, 2004

(51) Int. Cl.[7] ..... H01H 25/04
(52) U.S. Cl. ..... 200/6 A; 200/5 R
(58) Field of Search ..... 200/4, 5 R, 6 A, 200/17 R, 18; 345/161

(56) References Cited

U.S. PATENT DOCUMENTS 5,327,162 A * 7/1994 Soma ..... 345/161
5,631,453 A * 5/1997 Maeda ..... 200/6 A
6,528,740 B2 * 3/2003 Miyoshi ..... 200/5 R
6,608,263 B2 * 8/2003 Myojin ..... 200/16 D
6,657,141 B1 * 12/2003 Myojin ..... 200/6 A
6,689,967 B2 * 2/2004 Myojin ..... 200/18
6,700,565 B2 * 3/2004 Niiyama ..... 345/172

* cited by examiner

*Primary Examiner*—Michael A. Friedhofer
(74) *Attorney, Agent, or Firm*—Alfred A. Fressola; Ware, Fressola, Van Der Sluys & Adolphson

(57) ABSTRACT

A finger controllable switching device (10) is provided with at least one connector element (107) for inputing information to the electronic device by connecting and disconnecting an electrical connection to the electronic device. A finger touchable key member (102) is arranged to select a switching position by a planar multi-directional movement of the key member towards triggering means (103) which are arranged to push against at least one connector element to make a connection. An elastic member (101) supports the key member to its rest position and restores the key member to its rest position to disconnect at least one connector element, when the key member is released from the finger's grip.

19 Claims, 10 Drawing Sheets

FINGER-CONTROLLABLE MULTI-DIRECTIONAL SWITCH

TECHNICAL FIELD OF THE INVENTION

The present invention generally relates to an input device for portable electronic devices, and more particularly to the finger controllable multi-directional movement switching device to be used to input information to the electronic devices.

BACKGROUND OF THE INVENTION

Various electrical input devices are well known for controlling the positioning, movement and operation of a responsive electronic device, such as a cursor movement over a computer display screen. The most commonly known devices are known as a mouse that transmits through a connecting cable to the computer a signal varied by the amount and direction of movement of the mouse ball and causes the cursor on the display screen to have a corresponding movement. A command to the computer of the selected position of the cursor is communicated upon pressing a button on top of the mouse.

Another well known electrical input device is a joystick which is typically an elongated stick extending from computer console. The joystick is operated by tilting the stick in various directions to cause the cursor to move in a direction corresponding to the direction exerted on the stick. The operation of the joystick typically requires a separate button to be pushed to make a desired selection. Also a multi-directional switch comprising a joystick and switch is known in prior art for controlling the cursor movement and selection operations using a single shaft device where the joystick is inclined for selective operation of a plurality of switch portions. This kind of joystick includes a portion supported pivotally about a pivot fulcrum, e.g. by providing a socket for the pivot ball or gimbal to enable the stick to have a pivotal movement. The joystick may be returned to its rest or neutral position by elastic forces accumulated in various spring arrangements when the stick is released.

In recent years, there has been a trend to use different combination push switch devices wherein a plurality of switch elements are put together on a base and on top of the switch element there is a disk element. According to prior art a stick element coheres to the middle of the disk to transform the tilting motion into push motion. By tilting the stick, the disk will push the switch element beneath it. In order to lower exertion of tilting force, the stick element has to be long enough. Therefore the required tilting force will be lowered by elongating the stick from its fulcrum. Consequently, the longer stick will increase the thickness of the whole switching device.

To eliminate the thickness problem, the stick may be removed. Instead of the stick there could be placed a single key or multiple keys on top of the plurality of switch elements. In order to push different switch elements sequentially, the user needs to move his finger along the top surface of the single or multiple keys and press the key on top of each switch element to connect the switch element. After this he has to release his finger from the key to disconnect the switch element and then transfer his finger onto another key surface locating on top of next switch element to repeat the push and release motion. In this way, the user's finger has to move, push and release frequently in order to push different switch elements. It will increase the complexity of operation.

SUMMARY OF THE INVENTION

An object of the invention is to provide a finger controllable switching device which permits an easy to use switching operation for multiple connector elements, eliminates a need for exertion of tilting force by user's finger and permits a size reduction in the lateral direction.

The object of the invention is achieved by providing a switching device where a planar multi-directional movement of a flat key type arrangement controlled by a user connects and disconnects an electrical connection from connector elements of the switching device to the electronic device when inputting information to the electronic device.

In accordance with the invention there is provided a finger controllable switching device provided with at least one connector element for inputing information to the electronic device by connecting and disconnecting an electrical connection to the electronic device, wherein the switching device comprises:

- a finger touchable key member arranged to select a switching position by a planar multi-directional movement of the key member made by the finger towards said at least one connector element,
- triggering means arranged to be pushed against said at least one connector element by said planar multi-directional movement of the key member to connect said at least one connector element, and
- an elastic member arranged to support the key member to its rest position and arranged to restore the key member to said rest position from said switching position by said planar multi-directional movement of the key member to disconnect said at least one connector element, when the key member is released from the finger's grip.

In a preferred embodiment the triggering means are arranged to be located in a movable way by supporting means in proximity to said at least one connector element and at least partly at the same planar level as the key member. Preferably the key member in its rest position is arranged to be located mainly inside an inner perimeter of the area formed by connecting tangentially to each other adjacent triggering means according to said inner perimeter.

In another preferred embodiment a key member comprises a center disk and a center knob attached to the center area of the center disk, and the elastic member is arranged to support the combination of a center disk and a center knob.

In still another preferred embodiment an elastic member is arranged to be attached to the front cover to support the combination of a center disk and a center knob to the rest position of the key member.

Preferably, triggering means are arranged to push in a planar direction said at least one connector element when the outer perimeter of the center disk is pushed towards an inner perimeter of the triggering means to connect said at least one connector element.

A benefit of the embodied invention provides a solution in which there is no need to transform a tilting motion into a push motion. Instead a working principle is to transform a planar movement to a push motion. According to the invention a long stick is eliminated by a thin knob. Therefore, the thickness of the whole switching device, i.e. a size in the lateral direction, is thinner than the thickness of a typical tilting stick type switching devices. Also, the movement of end user's finger is a planar movement instead of a tilting motion, pressing action, rotary action or any complex combination of those. This will ease the use of the switching device. In addition, a multi-directional key arrangement of the switching device according to the invention is returned to its rest position by the elastic restoring force of the elastic key mat when the user releases his finger's grip from the key. Hence, any particular part for returning the key arrangement to the rest position or any securely determined fulcrum is not required.

BRIEF DESCRIPTION OF THE DRAWINGS

An embodiment of the invention will be described in detail below, by way of example only, with reference to the accompanying drawings, of which

DETAILED DESCRIPTION

Figure 1A:
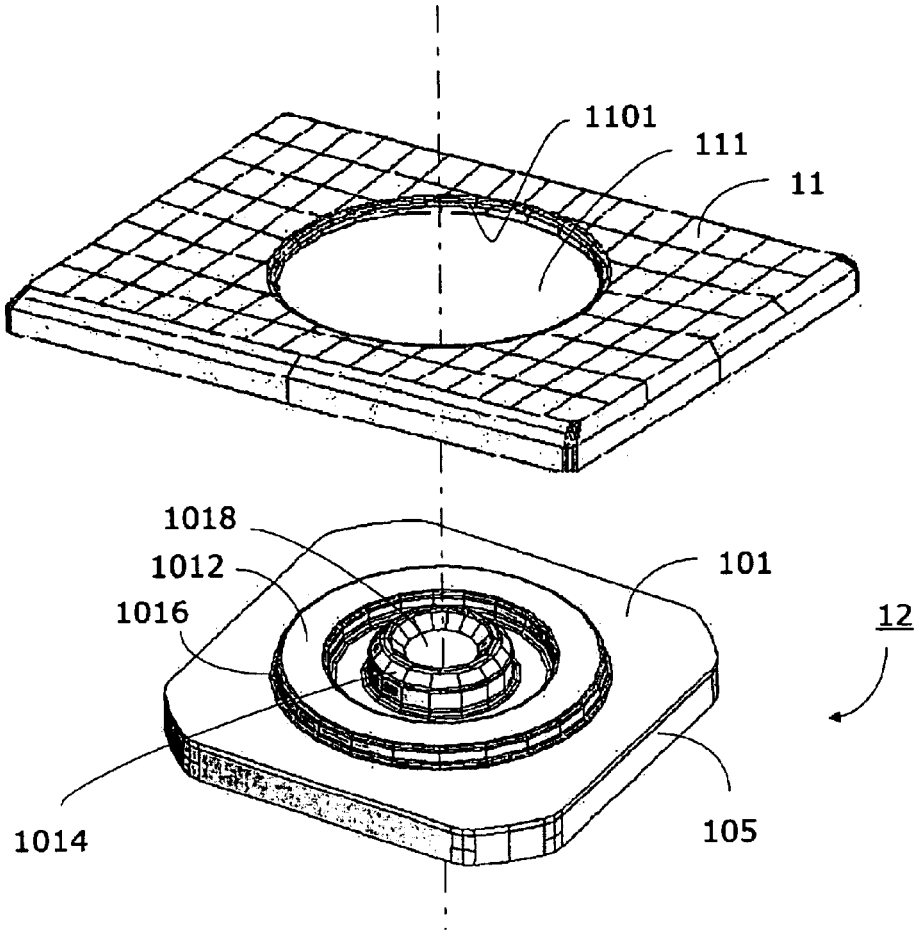
FIG. 1*a* depicts a perspective view of an embodiment according to the invention.
Figure 1B:
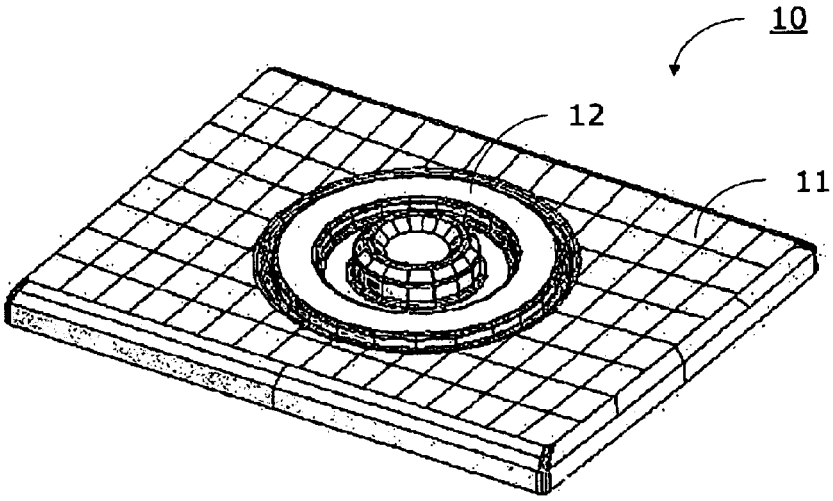
FIG. 1*b* depicts a perspective view of an embodiment according to the invention.

Referring to FIGS. 1*a* and 1*b* a perspective view of an embodiment of the switching device 10 according to the invention is shown. A key cover part 11 is provided with the aperture 111 of suitable size for mounting therein the protruding part of the switching assembly 12 underneath comprising at least a key assembly (not shown here), a elastic keymat 101 on top of the key assembly and a frame structure 105. According to an embodiment of the invention the elastic keymat covers the whole key assembly. FIG. 1*a* shows other outwards visible parts forming part of the surface of the elastic keymat protruding out of the aperture 111 and these parts are a prepared surface 1018 for user's finger confined by a ridge 1014 to facilitate the grip of the finger to move the key multi-directionally. The elastic ridge surface 1012 encompassing the inner ridge 1014 provides an element which supports the key assembly to its rest position and also supports it against a periphery of aperture 1101 when a planar multi-directional movement of the key is made a finger. In addition, the elastic ridge member tends to restore the key to its rest position when the finger's grip form the prepared surface 1018 confined by the ridge 1014 is released. Besides elasticity effect the material of the elastic keymat has to be rigid enough, e.g. rubber. The elastic ridge surface 1012 can also be folded. The elastic keymat is attached to the key assembly by an adhesive bonding, e.g. glueing.

As shown in FIG. 1*b* by mounting the key cover part 11 on top of switching assembly 12 the switching device 10 according to the invention is operational. The rubber keymat may be secured to its place by fixing it to the key cover part e.g. with metal lips and on the other side of the key cover the ruber keymat may be secured to its place by joining the rubber keymat and the key cover in a rim region in proximity to the periphery of the aperture 111 outside the elastic ridge 1012 by double shot mould.

Figure 9:
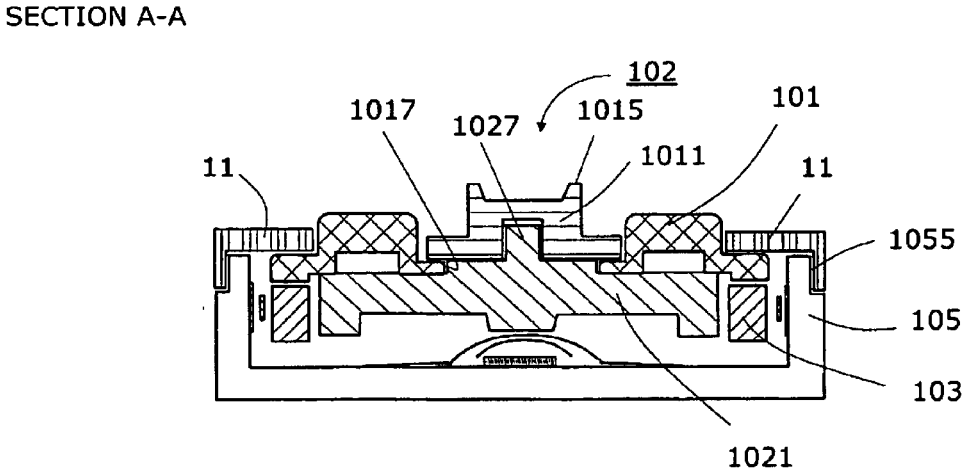
FIG. 9 depicts a cross-section diagram of another embodiment according to the invention along the cutting line A—A shown in any preceding figures.

According to another embodiment of the invention the elastic keymat has an opening 1017, as explained in association with FIG. 9, which periphery is adapted to follow an outer periphery of the ridge 1014 so that a part of the key assembly is protruding from the opening and visible outwards.

Figure 2:
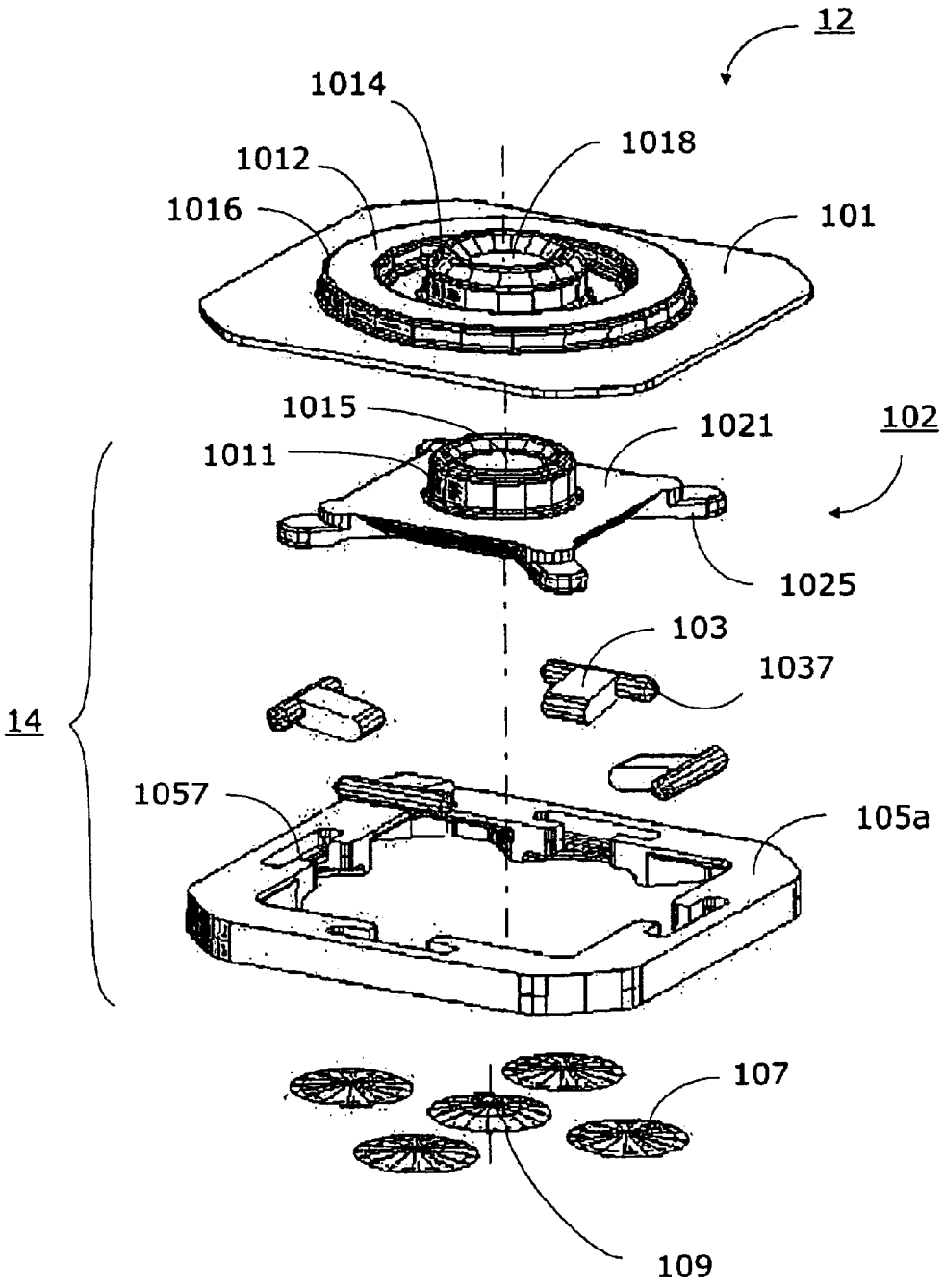
FIG. 2 depicts an exploded perspective view of an embodiment according to the invention.

FIG. 2 shows an exemplary assembly of some main parts of an embodiment of the switching device 10 according to the invention. A switching assembly 12 shown comprises the elastic keymat 101 with ridge surfaces 1012, 1014 described above, a key assembly 14 and connector elements 107, 109. The key assembly 14 comprises a center key 102, triggering parts 103 and a frame 105*a*. The center key 102 includes a projecting part 1011, preferably a key knob, having a prepared surface for user's finger confined by a ridge 1015 to facilitate the grip of the finger to move the center key multi-directionally. The center key 102 may also have a separate center disk 1021 to be attached to the center knob 1011 or it may be composed of one single piece processed by moulding process. The center key and center disk as well as triggering parts are typically made of plastic or synthetic resin.

The triggering parts 103 are arranged to be located in proximity of the connector elements in a movable way by supporting means 1037, 1057. As an example micro levers 103 may be used as triggering parts which are movably attached to the frame 105*a* by means of projecting shafts 1037 of the lever and a corresponding cut-outs 1057 of the frame to embed the lever. As described later many other kinds of triggering parts may be used.

Electrical connection to the main electronic device is provided by connecting a connector element 107, 109 of the switching device to corresponding contacts 1023, 1041 (see FIG. 3*b*) connected to the main device in proximity of the connector element. As an example, connector elements 107, 109 may be membrane metal domes or metal domes covered by a insulating dome sheet. The electrical connection is accomplished in the known way by matching together the connector element with the corresponding contact. The membrane domes 107, 109 may be either contacted on a printed wired board (PWB), flexible cable or integrated to the switching assembly 12 as surface mounted components.

Figure 3A:
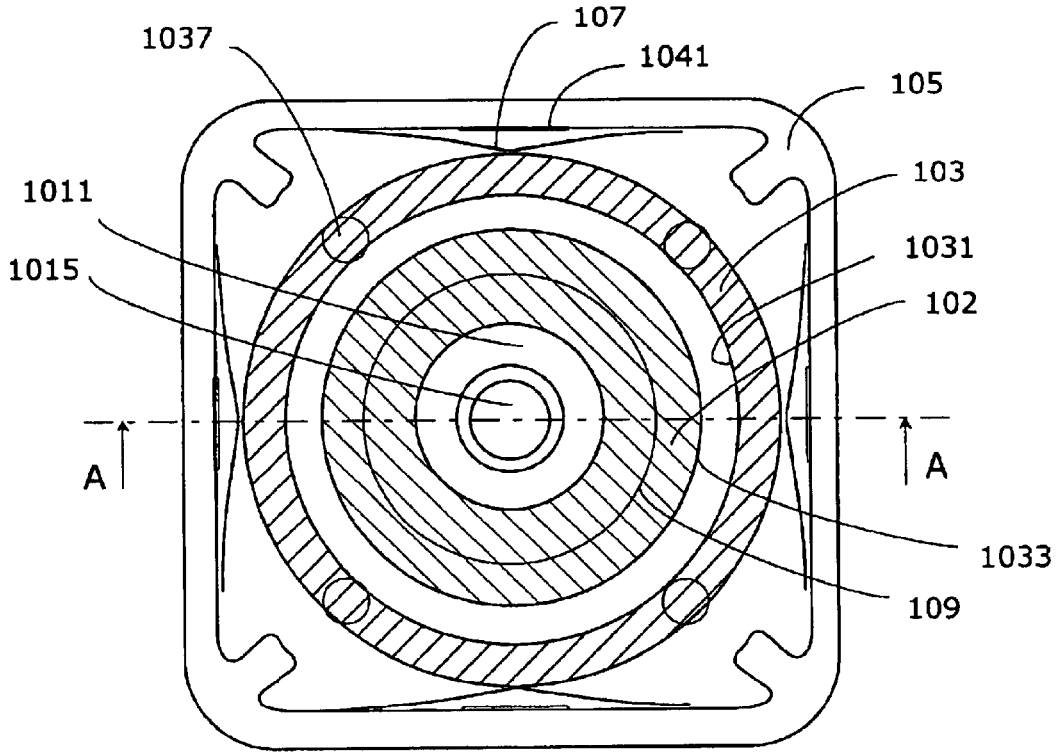
FIG. 3*a* depicts a front view of a first embodiment of the invention.

Referring now to FIG. 3*a* there is shown a front view of an embodiment of the invention comprising a center key 102 with a center knob 1011 having a ridge 1015 for finger's grip, a rim like triggering part, a trigger rim 103 with supporting bars 1037 and metal domes 107 attached to the frame structure 105. The frame structure also comprises connectors 1041 to the electronic device in proximity to the metal domes. In its rest position the center disk 1021 of the center key is arranged to be located inside an inner perimeter of the area formed by trigger rim. The trigger rim 103 is supported towards the back plane underneath by supporting bars 1037 in a way that the rim is able to make a multi-directional planar movement against the frame along the planar movement of the center key. In this embodiment the shape of the inner perimeter 1031 of the trigger ring follows the shape of the outer perimeter 1033 of the center disk, i.e. both said perimeters are round. FIG. 3*a* shows the center key in its rest or neutral position the switching device being switched off. The rest position is maintained by the combination of the elastic keymat (not shown) and the key cover part (not shown) which intends to restore the center key to its rest position when the finger's grip is released from the key knob as explained earlier.

Figure 10:
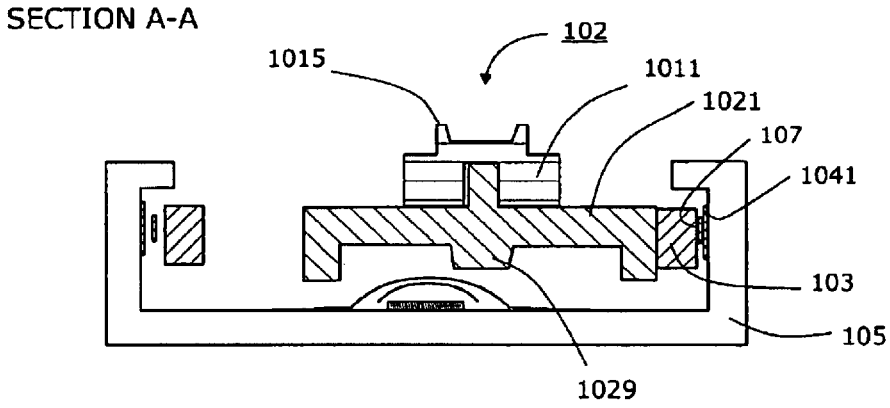
FIG. 10 depicts a cross-section diagram of one embodiment according to the invention along the cutting line A—A shown in preceding FIGS. 3 and 4.

Referring to FIG. 10 in association with FIG. 3*a* there is shown that by a planar movement of the center key 102 made by the finger towards any connector dome 107 the trigger rim 103 is moved towards said connector dome. When the trigger rim is pushed against said connector dome in a way that the connector dome will make a contact with the connector contact 1041 of the electronic device the switching device 10 is switched on. Preferrably, the connector dome is a sliced metal sheet having a dome peak in the middle of the sheet and being attached to the frame structure 105 on both ends of the sheet. In a static or constant state the connector dome is tensioned so that the connector dome 107 and connector contact 1041 are separated from each other. When the center key is released from the finger's grip, it will restore to its rest position and the trigger rim is pushed to its rest position by a propulsive force caused by connector dome trying to restore its constant shape in a known way. As a result of this the switching device is switched off. FIG. 3*a* also shows a center connector dome 109 dashlined below the center key 102 which also defines the area of the rest position of the center key.

Figure 3B:
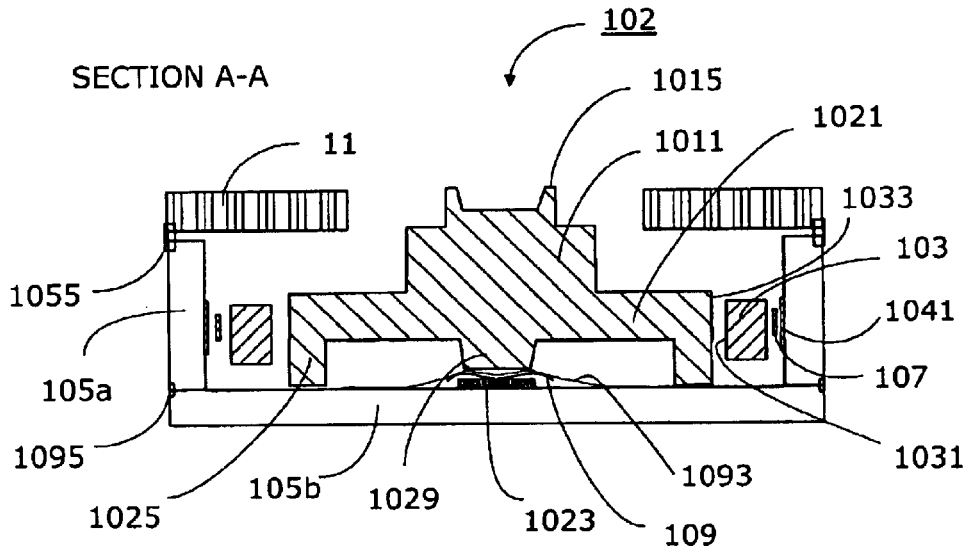
FIG. 3*b* depicts a cross-section diagram of the first embodiment shown in FIG. 3*a* along a cutting line A—A.

FIG. 3*b* shows a cross-sectional view of an embodiment depicted in FIG. 3*a* along a dashed cutting-line A—A. The switching device 10 according to the invention comprises in addition to the main parts shown in FIG. 2 the key cover part 11 described earlier in association with FIGS. 1*a* and 1*b* and a frame structure 105 which can be a frame 105*a* or side frame 105*a* and/or a back plane 105*b*. The frame structure can also be a combination of a frame and a back plane which is called a back cover part 105 in this description. The key cover part is attached to the frame 105*a* or to the back cover part 105 by any suitable fixing means 1055. The back plane 105*b* is attached to the frame on the other side than the key cover part by any suitable fixing means 1095, if the back plane 105*b* and the frame 105*a* are separate parts. The back plane may also be part of the frame 105*a* when the combination forms the back cover part 105 which is attached to the key cover part by any suitable fixing means 1055 to house and protect the key assembly 14 and connector elements 107, 109 inside the switching device 10. The key cover part is preferably made of sheet metal and the back plane or back cover is preferably made of plastic double shot with sheet metal connectors. According to one embodiment of the invention a connector assembly 1023, 1041 for electrical connection to the electronic device may comprise a corner connector, center connector and at least one side connector attached to the back plane or the back cover.

As shown in FIG. 3*b*, the center key 102 having a center disk part 1021 below the key knob 1011 is located in its rest position and the center connector dome 109 protected by the dome sheet 1093 is located below the center area of the center key. A connector contact 1023 to the electronic device is attached to the back plane 105*b* or back cover part 105 of the switching device 10. When the center key 102 is pressed by the finger in its rest position of the center key to connect the center connector dome 109, as shown in FIG. 3*b*, a projection 1029 being part of the center disk 1021 pushes the center connector dome against the connector contact 1023, and the switching device is switched on. When the finger's grip is released from the center knob the projection of the center key is pushed to its rest position by a propulsive force caused by center connector dome trying to restore its constant shape in a known way. As a result of this the switching device is switched off as is the situation in FIGS. 7 to 9. The movement of the trigger ring 103 is independent of the vertical movement of the center disk 1021.

Figure 4A:
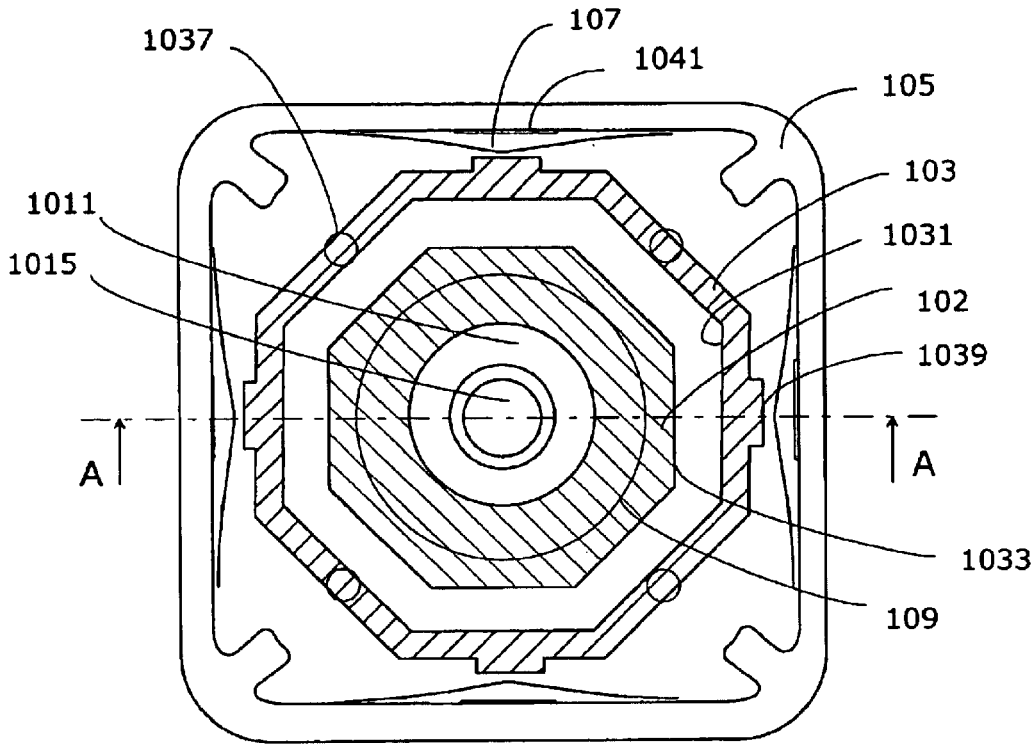
FIG. 4*a* depicts a front view of a second embodiment of the invention.
Figure 4B:
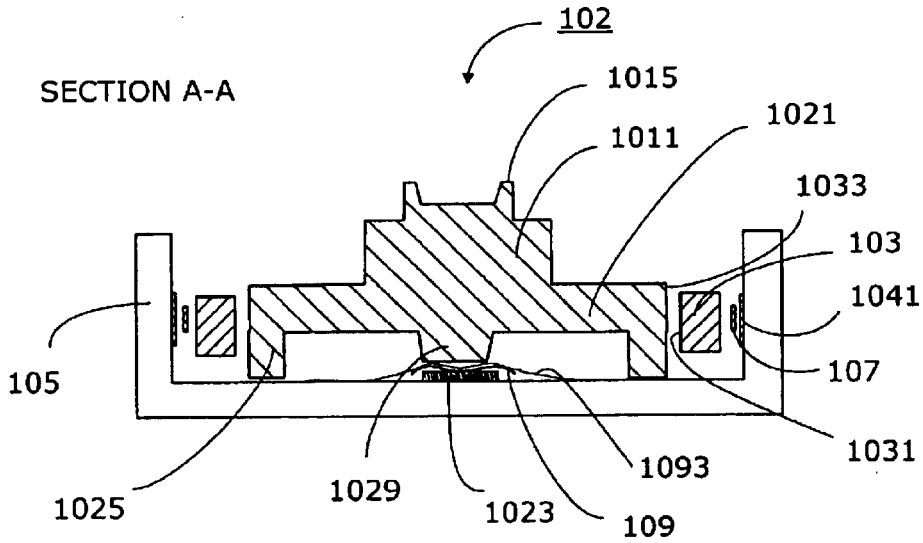
FIG. 4*b* depicts a cross-section diagram of the second embodiment shown in FIG. 4*a* along a cutting line A—A.

FIGS. 4*a* and 4*b* show a front and cross-section view of another embodiment of the invention comprising a center key 102 with a center knob 1011 having a ridge 1015 for finger's grip, a rim like triggering part 103 with supporting bars 1037 and metal domes 107 attached to the frame structure 105 or the wall of the back cover 105. Preferrably, the connector dome is a sliced metal sheet having a dome peak in the middle of the sheet and being attached to the frame or wall of the back cover on both ends of the sheet. The frame/back cover also comprises connectors 1041 to the electronic device. In a static or constant state the connector dome is tensioned so that the connector dome 107 and connector contact 1041 are separated from each other. The trigger rim 103 is supported towards back plane underneath by supporting bars 1037 in a way that the rim is able to make a multi-directional planar movement against the frame along the planar movement of the center key. In this embodiment the shape of the inner perimeter 1031 of the trigger ring follows the shape of the outer perimeter 1033 of the center disk, i.e. both said perimeters are squared, polygonal or alike, respectively. FIG. 4*a* shows the center key in its rest or neutral position the switching device being switched off. The rest position is maintained by the combination of the elastic keymat and the key cover part which intends to restore the center key to its rest position when the finger's grip is released from the key knob as explained earlier. FIG. 4*b* shows the center key in its rest or neutral position in the planar direction and the center key 102 pressed by the finger in this position to connect the center connector dome 109 by means of the projection 1029 of the center disk 1021 pushing the center connector dome against the connector contact 1023 below. As a result the switching device 10 is switched on. The movement of the trigger ring 103 is independent of the vertical movement of the center disk 1021. The working principle of the embodiment depicted in FIGS. 4*a* and 4*b* is the same as described earlier in connection of FIGS. 3*a* and 3*b*.

Figure 5A:
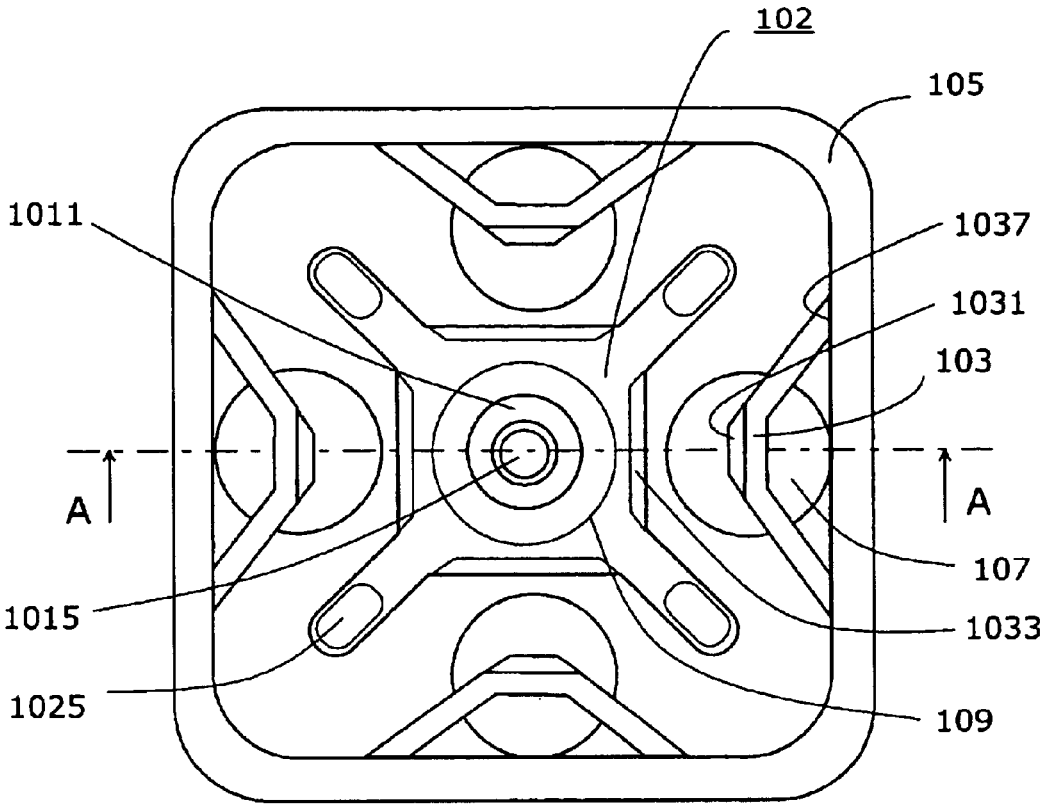
FIG. 5*a* depicts a front view of a third embodiment of the invention.
Figure 5B:
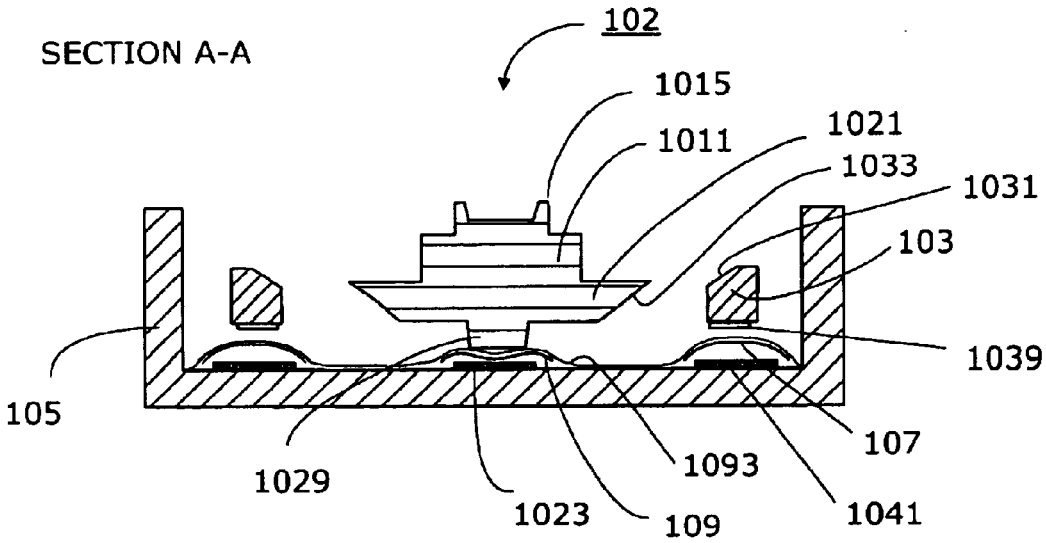
FIG. 5*b* depicts a cross-section diagram of the third embodiment shown in FIG. 5*a* along a cutting line A—A.

Referring to FIGS. 5*a* and 5*b* there are shown a front and cross-sectional view of another embodiment of the invention comprising a center key 102 with a center knob 1011 having a ridge 1015 for finger's grip, triggering parts 103 supported by springy joints 1037 and metal domes 107 covered by a dome sheet 1093 attached to the back plane of the frame structure 105 or the wall of the back cover 105. The back plane/cover also comprises connectors 1041 to the electronic device in proximity to, preferably below, the metal domes. The triggerring part 103, e.g. a trigger plunger bar, is supported by springy joints 1037 on both ends attached to the side frame of the frame structure or the back cover 105. The trigger plunger bar and the center disk are at least partly at same planar level and in the rest position the center disk is located inside the inner perimeter 1031 of the area formed by connecting adjacent trigger bars tangentially in relation to the inner perimeter 1031 to each other.

The perimeter of the trigger plunger bar 103 nearest to the center center key 102 has a slide surface 1031 with a bevel edge upwards and the slide surface is arranged to move in vertical direction in relation to the springy joints 1037. Correspondingly, the outer perimeter of the center disk 1021 of the center key has a slide surface 1033 with a bevel edge downwards so that said bevel edges face each other. When the center key is pushed by a multi-directional planar movement towards the trigger plunger bar 103 the trigger bar move vertically downwards when the slide surface 1033 faces the opposite slide surface 1031. The center disk is also arranged to have protruding legs 1025 to slide against the corners of the frame 105*a* or back cover 105 to stop the movement of the center key and thus prevent so called key jamming. When the center key is blocked by the frame, it prevents the center key protruding upwards from the level of the planar multi-directional movement of the center key.

FIG. 5*a* shows the center key in its rest or neutral position the switching device being switched off. The rest position is maintained by the combination of the elastic keymat (not shown) and the key cover part (not shown) which intends to restore the center key to its rest position when the finger's grip is released from the key knob as explained earlier. FIG. 5*a* also shows a center connector dome 109 dashlined below the center key 102 which also defines the area of the rest position of the center key. FIG. 5*b* shows the center connector dome 109 to be covered by the same dome sheet 1093 as the other connector domes 107. When the center key 102 is pressed by the finger in its rest position to connect the center connector dome 109, as shown in FIG. 5*b,* a projection 1029 being part of the center disk 1021 pushes the center connector dome against the connector contact 1023, and the switching device is switched on. The movement of the trigger plunger bar 103 is independent of the vertical movement of the center disk 1021. The working principle of this embodiment is described more detail in association with FIG. 11.

Figure 6A:
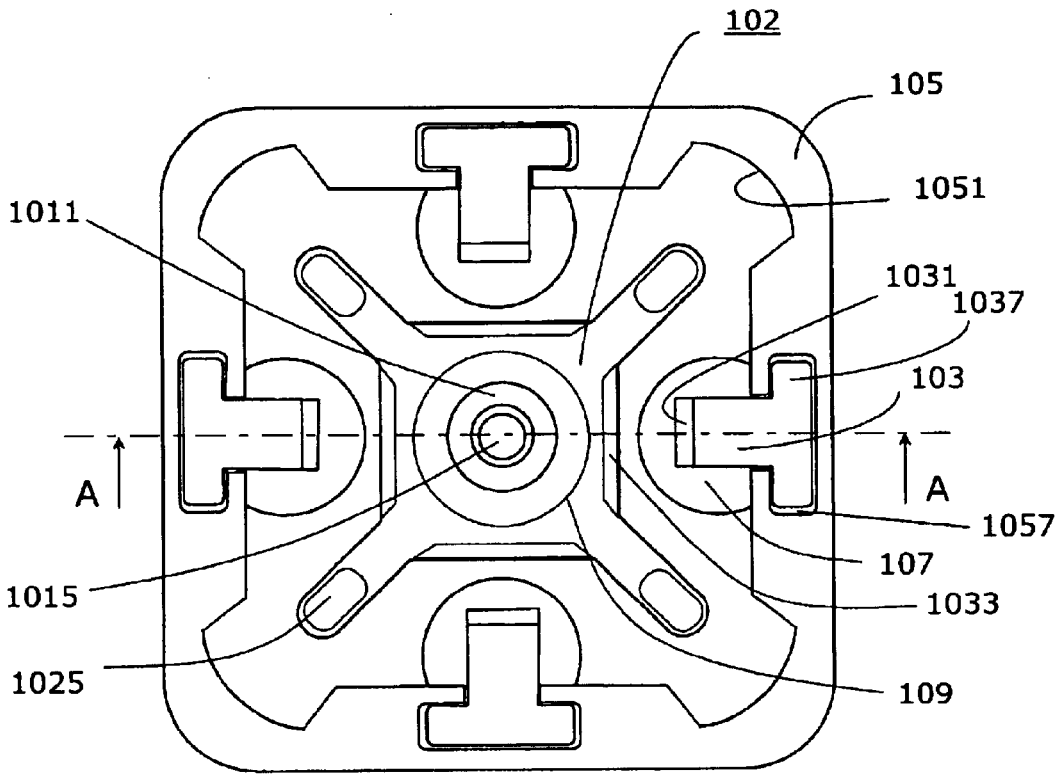
FIG. 6*a* depicts a front view of a fourth embodiment of the invention.
Figure 6B:
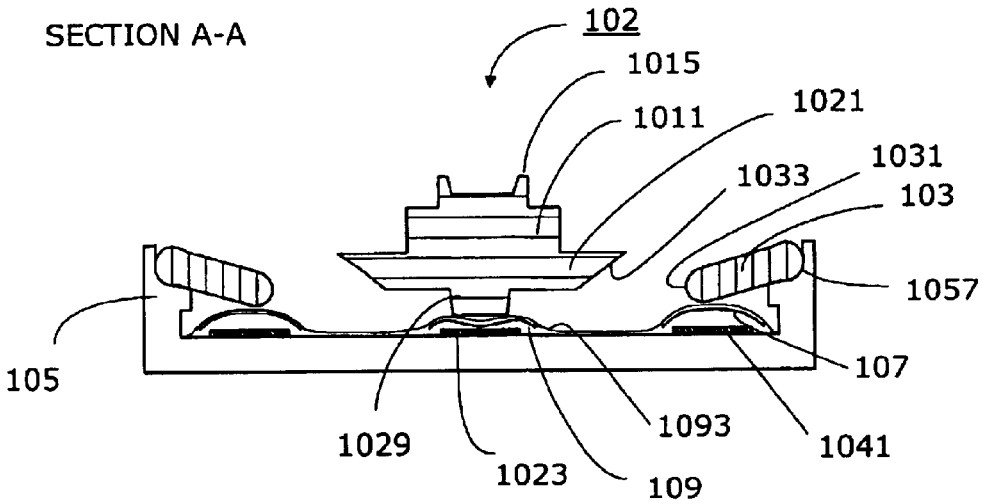
FIG. 6*b* depicts a cross-section diagram of the fourth embodiment shown in FIG. 6*a* along a cutting line A—A.

Referring to FIGS. 6*a* and 6*b* there are shown a front and cross-section view of another embodiment of the invention comprising a center key 102 with a center knob 1011 having a ridge 1015 for finger's grip, triggering parts 103 supported by a cavity 1037 of the frame structure 105 or the back cover part 105 and metal domes 107 attached to the back plane 105*b* or the wall of the back cover 105. The back plane/cover also comprises connectors 1041 to the electronic device in proximity to, preferably below, the metal domes. The triggerring part 103, e.g. a micro lever, is supported by shoulders 1037 of the micro lever and a cavity 1057 of the frame 105*a* or the back cover 105, the micro lever to be movably attached to the frame 105*a* or the back cover 105. The micro lever and the center disk are at least partly at same planar level and, in the rest position, the center disk is located inside the inner perimeter 1031 of the area formed by connecting adjacent trigger bars tangentially in relation to the inner perimeter 1031 to each other. The center disk is also arranged to have protruding legs 1025 to slide against a block cavity 1051 of the frame 105*a* or back cover 105 to stop the movement of the center key and thus prevent so called key jamming. When the center key is blocked by the block cavity, it prevents the center key protruding upwards from the level of the planar multi-directional movement of the center key.

The perimeter of the micro lever 103 nearest to the center key 102 has a round surface 1031 and the round surface end of the micro lever is arranged to move in the vertical direction in relation to the shoulders 1037 in the cavity 1057. Correspondingly, the outer perimeter of the center disk 1021 of the center key has a slide surface 1033 with a bevel edge downwards. When the center key is pushed by a multi-directional planar movement towards the micro lever 103 it will move vertically downwards when the slide surface 1033 faces the opposite round surface 1031. FIG. 6*a* shows the center key in its rest or neutral position the switching device being switched off. The rest position is maintained by the combination of the elastic keymat (not shown) and the key cover part (not shown) which intends to restore the center key to its rest position when the finger's grip is released from the key knob as explained earlier. FIG. 6*a* also shows a center connector dome 109 dashlined below the center key 102 which also defines the area of the rest position of the center key. FIG. 6*b* shows the center connector dome 109 to be covered by the same dome sheet 1093 as the other connector domes 107. When the center key 102 is pressed by the finger in its rest position to connect the center connector dome 109, as shown in FIG. 5*b,* a projection 1029 being part of the center disk 1021 pushes the center connector dome 109 against the connector contact 1023, and the switching device is switched on. The movement of the micro lever 103 is independent of the vertical movement of the center disk 1021. The working principle of this embodiment is described more detail in association with FIG. 11.

Figure 11:
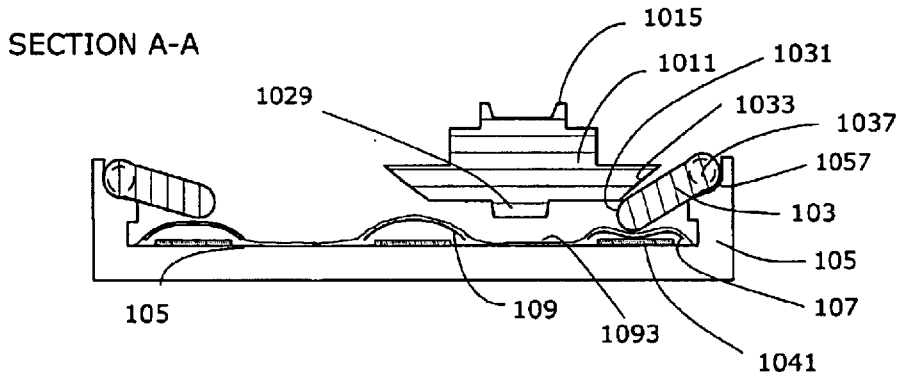
FIG. 11 depicts a cross-section diagram of another embodiment according to the invention along the cutting line A—A shown in preceding FIGS. 5 and 6.

Referring to FIG. 11 in association with FIGS. 5*a,* 5*b,* 6*a* and 6*b* there is shown that by a planar movement of the center key 102 made by the finger towards the trigger part, e.g. the plunger bar or micro lever 103, will push the trigger plunger bar or micro lever to move towards the connector dome 107. When the trigger part is pushed against said connector dome in a way that the connector dome will make a contact with the connector contact 1041 of the electronic device the switching device 10 is switched on. In a static or constant state the connector dome 107 is tensioned so that the connector dome 107 and connector contact 1041 are separated from each other. When the center key is released from the finger's grip, it will restore to its rest position and the trigger rim is pushed to its rest position by a propulsive force caused by connector dome trying to restore its constant shape in a known way. As a result of this the switching device is switched off. As seen in FIG. 11 the center key 102 having a center disk part 1021 below the key knob 1011 is located in its switching on position. When the finger's grip is released from the center knob the rest position is maintained by the combination of the elastic keymat (not shown) and the key cover part (not shown) which intend to restore the center key to its rest position as explained earlier. As a result of this the switching device is switched off.

Figure 7:
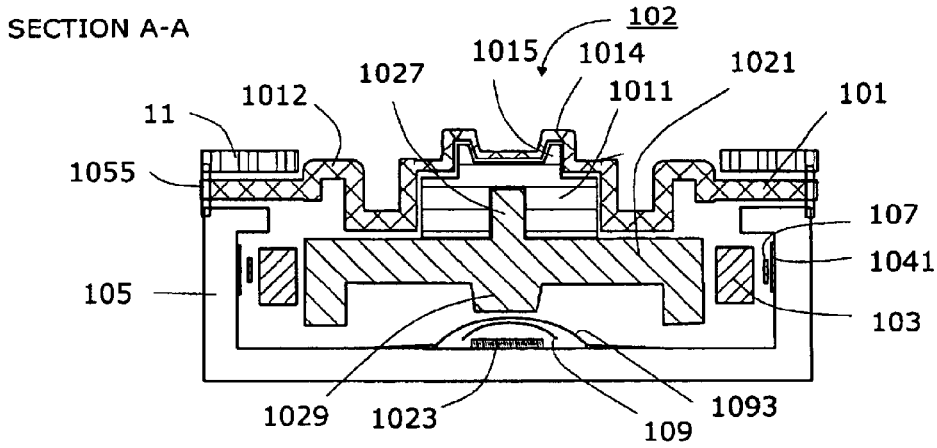
FIG. 7 depicts a cross-section diagram of one embodiment according to the invention along the cutting line A—A shown in any preceding figures.
Figure 8:
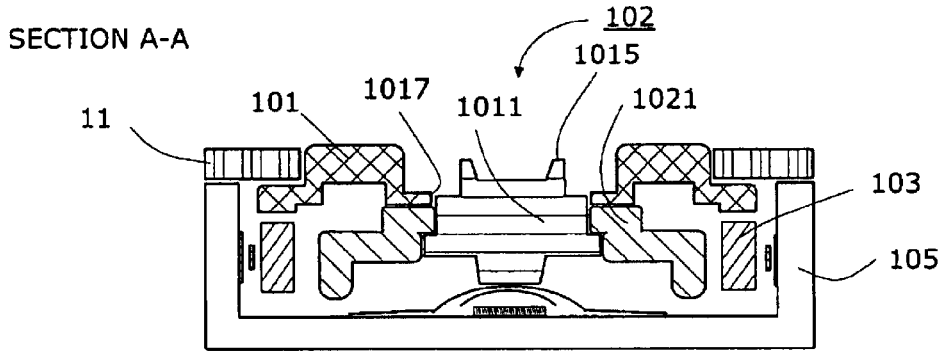
FIG. 8 depicts a cross-section diagram of another embodiment according to the invention along the cutting line A—A shown in any preceding figures.

FIGS. 7, 8 and 9 show different embodiments of the invention to attach the key assembly 14 to the elastic keymat. In FIG. 7 the keymat covers the whole key assembly as explained earlier in association to FIGS. 1 and 2. FIGS. 8 and 9 show a situation the elastic keymat having an opening 1017 which periphery is adapted to follow an outer periphery of the ridge 1015 of the center key 102. The center knob 1011 is attached to the center disk 1021 by means of a projection 1027 of the center disk and a corresponding cavity of the center knob. In FIG. 8 the center knob extends through an opening in the center disk 1021 and the center knob and the center disk are attached to each other in a suitable way to form a fixed combination. The rubber keymat 101 is placed on top the combination as shown in FIG. 7. FIG. 9 shows the elastic keymat having an opening 1017 which periphery is adapted to follow an outer periphery of the ridge 1015 of the center key 102 so that a part of the key assembly is protruding from the opening and visible outwards. In this embodiment the keymat is attached on top of the center disk and the center knob is fixed to the center disk in a way that the inner perimeter 1017 of the rubber keymat is attached between an edge of the key knob and the center disk. FIGS. 7 and 9 also set examples of how the front cover 11 is attached with the keymat and how the front cover 11 is attached to the back cover 105 with fixing means 1055.

Figure 12:
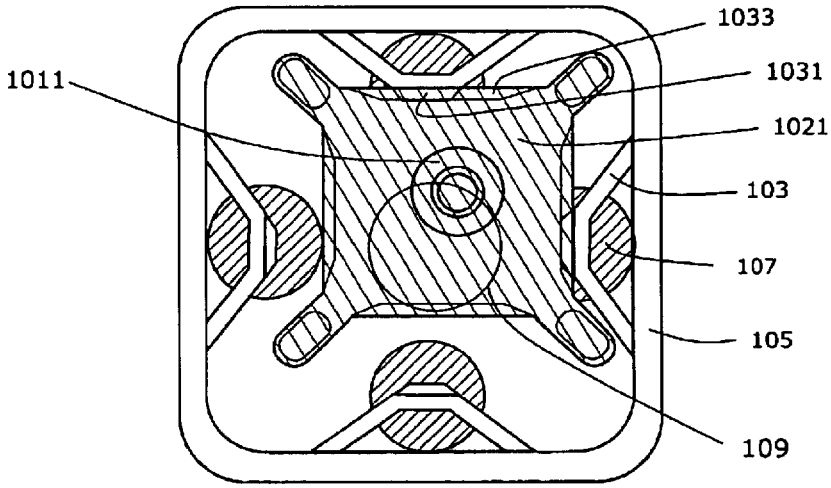
FIG. 12 depicts a front view of any embodiment according to the invention shown in any preceding figures.

Referring to FIG. 12 there is shown an embodiment of the invention when the center key 102 is moved towards a corner of the switching device by a planar multidirectional movement of the key knob 1011 made by the finger to connect two adjacent connector domes 107 at the same time. The switching operation takes place in the same principle as earlier explained in connection with one connector dome with the exception that the triggering part(s) 103 push two connector domes at the same time. In an exemplary key assembly of an embodiment shown in FIG. 12 there are five connector domes each of them producing one switch function. The possibility to connect two adjacent connector domes simultaneously produces four extra switch functions to the same switching device. Hence altogether nine switch functions are possible with this single exemplary switching device according to the invention.

Figure 13A:
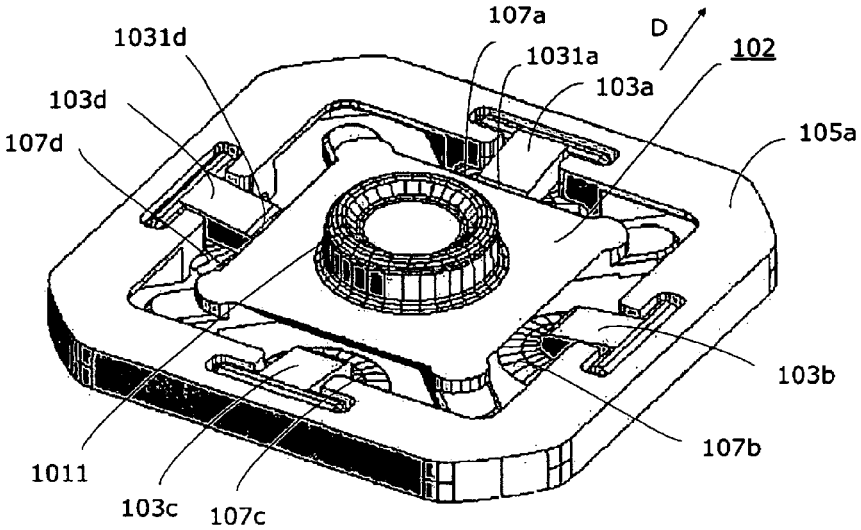
FIG. 13*a* depicts a perspective view of an embodiment according to the invention from one direction.
Figure 13B:
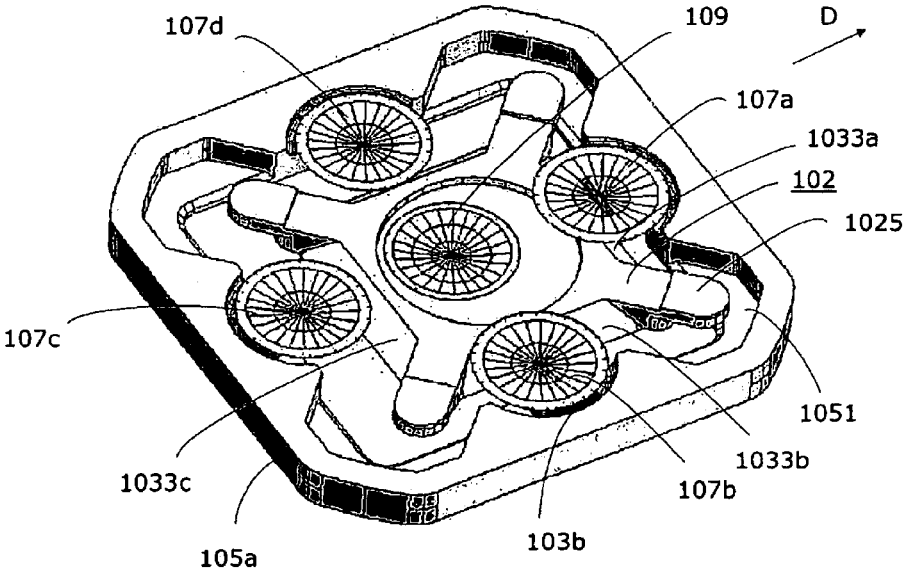
FIG. 13*b* depicts a perspective view of an embodiment according to the invention shown in FIG. 13*a* from another direction.

FIGS. 13*a* and 13*b* show a perspective view of one embodiment of the invention from two different sides. According to this embodiment of the invention there is shown four triggering parts 103*a*, 103*b*, 103*c* and 103*d* provided with four round surfaces 1031*a*, 1031*b*, 1031*c* and 1031*d* (all not shown). As shown in FIG. 13*b* the center key 102 is also provided with four slide surfaces 1033*a*, 1033*b*, 1033*c* and 1033*d* (all not shown). The connector domes bear references 107*a*, 107*b*, 107*c* and 107*d*, and the center connector dome 109. When a planar movement of the center key 102 is made by moving the center knob 1011 to the direction D the triggering part 103*a* push the connector dome 107*a* to switch on as explained earlier in association with FIGS. 10 and 11. Here is also shown, as explained earlier in connection to FIG. 6*a*, that the center key 102 is arranged to have protruding legs 1025 to slide against block cavities 1051 of the frame 105*a*.

Figure 14A:
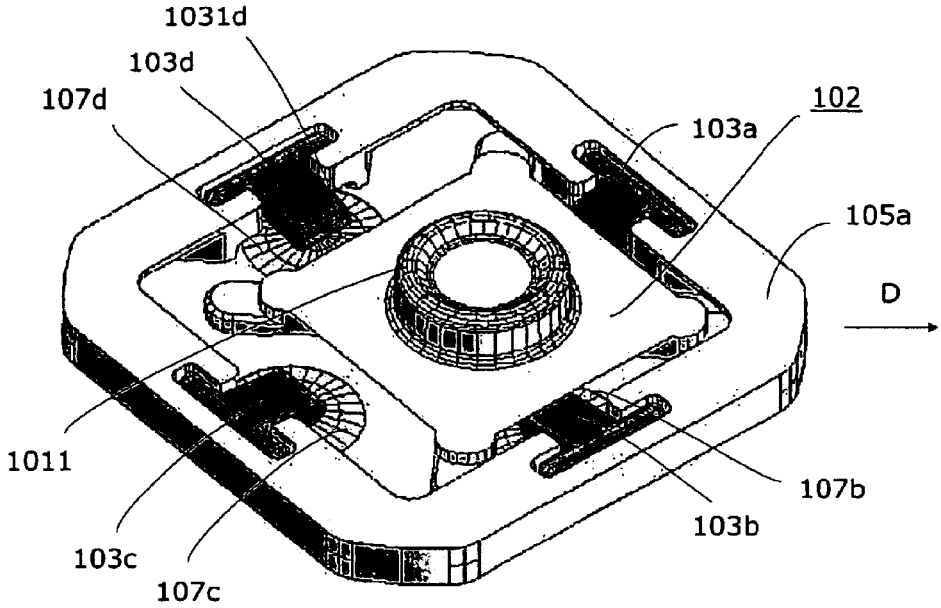
FIG. 14*a* depicts a perspective view of another embodiment according to the invention from one direction.
Figure 14B:
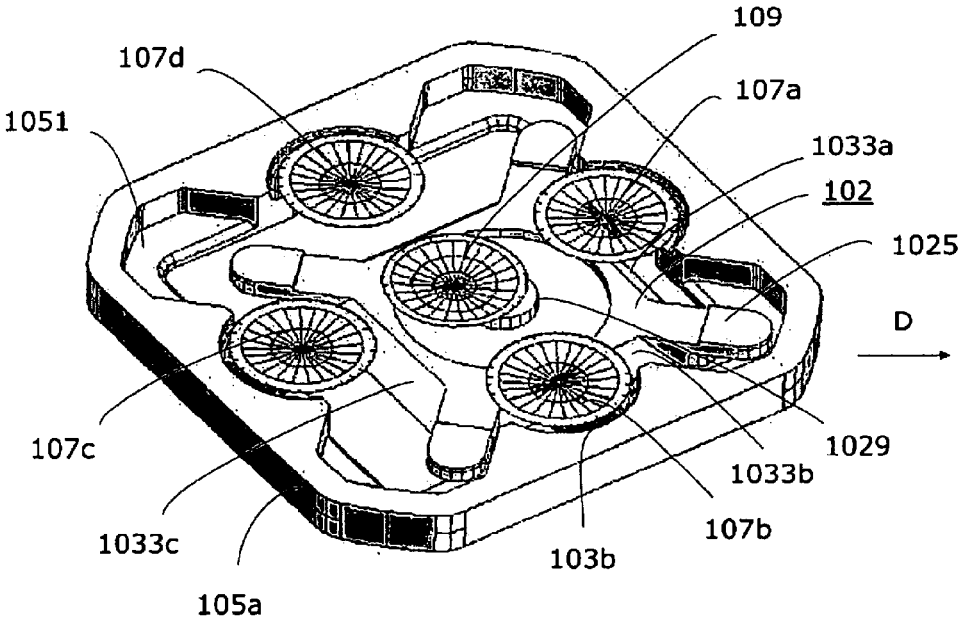
FIG. 14*b* depicts a perspective view of another embodiment according to the invention shown in FIG. 14*a* from another direction.

For their part FIGS. 14*a* and 14*b* show a perspective view of one embodiment of the invention from two different sides when two adjacent connector domes are connected at the same time. All components and parts bear the same references as in FIGS. 13*a* and 13*b*. When a planar movement of the center key 102 is made to the direction D the triggering parts 103*a* and 103*b* push the corresponding connector domes 107*a* and 107*b* to switch on simultaneously in the same way as explained earlier in association with FIGS. 10, 11 and 12.

The above embodiments of the invention may be used to input information to the portable electronic devices, such as mobile phones, communication devices, PDA devices, game devices and other similar consumer devices which need navigation and/or browsing control for the item selection and/or browsing on the screen of the protable electronic devices. Preferably, the above embodiments of the invention are usable in devices which have a need for a switching device with a flat center key or a flat combination of a center knob and canter disk. As potential dimensions of an embodiment of the switching device according to the invention a following example is given: total height 2.4 mm, length 10.30 mm and width 10.30 mm and height excluding center knob 1.75 mm for a 9 way switching device.

While this invention has been described with reference to illustrative embodiments, this description is not intended to be construed in a limiting sense. Various other embodiments of the invention will be apparent to persons skilled in the art upon reference to this description. It is therefore contemplated that the appended claims will cover any such modifications of the embodiments as fall within the true scope and spirit of the invention.

What is claimed is:

1. A finger controllable switching device provided with at least one connector element for inputing information to the electronic device by connecting and disconnecting an electrical connection to the electronic device, wherein the switching device comprises:

a finger touchable key member arranged to select a switching position by a planar multi-directional movement of the key member made by the finger towards said at least one connector element, triggering means arranged to be pushed against said at least one connector element by said planar multi-directional movement of the key member to connect said at least one connector element, and an elastic member arranged to support the key member in a rest position and arranged to restore the key member to said rest position from said switching position by said planar multi-directional movement of the key member to disconnect said at least one connector element, when the key member is released from a finger's grip.

2. A switching device according to claim 1, wherein the triggering means are arranged to be located in a movable way by supporting means in proximity to said at least one connector element and at least partly at the same planar level as the key member.

3. A switching device according to claim 2, wherein the key member in the rest position is arranged to be located mainly inside an inner perimeter of the area formed by connecting adjacent triggering means tangentially according to said inner perimeter to each other.

4. A switching device according to claim 3, wherein the key member comprises a center disk and a center knob attached to the center area of the center disk, and the elastic member on top of the key member is arranged to support the combination of the center disk and the center knob.

5. A switching device according to claim 4, wherein the elastic member is arranged to form on top of the center knob a prepared surface for the finger's grip and on top of the center disk an elastic ridge surface encompassing said prepared surface in a way that the center disk of the key member is capable of the multi-directional planar movement to connect in association with the triggering means the at least one connector element.

6. A switching device according to claim 5, wherein the switching device comprises a front cover arranged to have an aperture through which the elastic ridge surface is arranged to protrude and a periphery of the aperture is arranged to support an outer periphery of the elastic ridge surface when the planar multi-directional movement of the key member occurs.

7. A switching device according to claim 6, wherein the elastic member is arranged to have an opening through which the center knob or the center disk is at least partly arranged to protrude.

8. A switching device according to claim 7, wherein the elastic member is arranged to be attached to the front cover to support the combination of the center disk and the center knob to the rest position of the key member.

9. A switching device according to claim 4, wherein the triggering means are arranged to be pushed against said at least one connector element by an outer perimeter of the center disk to connect said at least one connector element.

10. A switching device according to claim 9, wherein the triggering means are arranged to push in the planar direction said at least one connector element when the outer perimeter of the center disk is pushed towards an inner perimeter of the triggering means to connect said at least one connector element.

11. A switching device according to claim 9, wherein an outer perimeter of the center disk of the key member and the inner perimeter of the triggering means comprise guiding means which are arranged to guide the planar movement of the key member to press vertically said at least one connector element when the outer perimeter of the center disk is pushed towards the inner perimeter of the triggering means to connect said at least one connector element.

12. A switching device according to claim 4, wherein the switching device comprises a center dome element below the key member arranged to be located in a center area of said rest position of the key member, and said center dome element is arranged to be electrically connected to the electronic device by connecting means when the key member is pressed in said rest position of the key member to be in the switching position and electrically disconnected when the key member is released from the switching position.

13. A switching device according to claim 12, wherein said center dome element is arranged to be separated from the key member when said planar multi-directional movement of the key member occurs.

14. A switching device according to claim 13, wherein the triggering means comprise at least one trigger ring which top view is arranged to follow a shape of the outer perimeter of the key member and which is arranged to be located in a movable way by supporting means between the key member and a side dome element at least partly at the same planar level as the key member.

15. A switching device according to claim 13, wherein the triggering means comprise at least one lever or spring frame projecting part arranged to be attached to the frame in a movable way by supporting means in proximity to a location of a bottom dome element so that the guiding means are arranged to be located at least partly at the same planar level as the key member.

16. A switching device according to claim 15, wherein the bottom dome elements are arranged to be located symmetrically around the center dome element on the back plane and on top of both the bottom and center dome elements is attached a single dome sheet.

17. A switching device according to claim 16, wherein the center disk of the key member is arranged to have a protruding leg to slide against a block cavity of the frame to stop the movement of the key member.

18. A switching device according to claim 1, wherein the switching device further comprises a frame arranged to be attached to the front cover by first fixing means to house and protect the key member and the triggering means, a back plane arranged to be attached to the frame on the other side than the front cover by second fixing means to house and protect the key member and the triggering means, and means for electrically connecting said at least one connector element to the electronic device.

19. A switching device according to claim 18, wherein a combination of the frame and the back plane which is arranged to form a back cover to be attached to the front cover by the first fixing means, wherein said combination is arranged to comprise means for electrically connecting said at least one connector element to the electronic device and said connector elements are arranged to be attached to at least one wall of the back cover.

* * * * *

UNITED STATES PATENT AND TRADEMARK OFFICE

CERTIFICATE OF CORRECTION

PATENT NO. : 6,831,238 B1
DATED : December 14, 2004
INVENTOR(S) : Lau

It is certified that error appears in the above-identified patent and that said Letters Patent is hereby corrected as shown below:

Title page,
Item [75], Inventors, please delete "Salo" and replace with -- Turku --.

Signed and Sealed this

Nineteenth Day of April, 2005

JON W. DUDAS
*Director of the United States Patent and Trademark Office*